US006339442B1

(12) United States Patent
Miyamoto et al.

(10) Patent No.: US 6,339,442 B1
(45) Date of Patent: Jan. 15, 2002

(54) IMAGE FORMING APPARATUS AND PROCESS

(75) Inventors: Akio Miyamoto; Kouya Kawabata, both of Shizuoka-ken (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/597,415

(22) Filed: Jun. 19, 2000

(30) Foreign Application Priority Data

| | | |
|---|---|---|
| Jun. 17, 1999 | (JP) | 11-170702 |
| Mar. 24, 2000 | (JP) | 12-083664 |
| May 31, 2000 | (JP) | 12-163273 |

(51) Int. Cl.[7] ..... B41J 2/325; B41M 5/26
(52) U.S. Cl. ..... 347/171
(58) Field of Search ..... 347/171, 172, 347/213

(56) References Cited

FOREIGN PATENT DOCUMENTS

| | | | |
|---|---|---|---|
| EP | 0929000 A * | 7/1999 | |
| JP | 62-117782 | 5/1987 | ..... B41M/5/00 |
| JP | 7-145576 | 6/1995 | ..... D06P/5/00 |
| JP | 7-276780 | 10/1995 | ..... B41M/5/00 |
| JP | 11-198421 A * | 7/1999 | |

OTHER PUBLICATIONS

Patent Abstract of Japan 62117782 May 29, 1987.

Patent Abstract of Japan 07145576 Jun. 06, 1995.

Patent Abstract of Japan 07276780 Oct. 24, 1995.

* cited by examiner

*Primary Examiner*—Huan Tran
(74) *Attorney, Agent, or Firm*—Sughrue Mion, PLLC

(57) ABSTRACT

An image forming process including the steps of: (a) providing an image transfer material having a transfer recording layer formed from a heat transfer material and an image receiving sheet; (b) image-wisely applying a transferability promoting material to one of the heat transfer material and the image receiving sheet to form a latent image; and (c) applying pressure and heat to the image transfer material to form an image on the image receiving material from the latent image.

17 Claims, 3 Drawing Sheets

IMAGE FORMING APPARATUS AND PROCESS

BACKGROUND OF THE INVENTION

1. Field of the Invention

The present invention relates to an image forming process which adapts a heat transfer process, and an image forming apparatus used for the imaging forming process.

2. Description of the Related Art

A heat transfer process is one of the processes used for forming an image on a transfer body such as paper, a film, or the like. In the heat transfer process, an image is formed on an image receiving sheet by the following steps: superposing a transfer body (a transfer sheet), in which a transfer layer comprising pigment-based dye which is a transfer material is provided on a surface of a substrate, with an image receptor (image receiving sheet) such as paper, a film, or the like; heating the superposed sheets image-wisely from the back surface side of the substrate of the transfer sheet with a thermal head, a laser head, or the like; and transferring the dye onto the image receiving sheet. In another version of the heat transfer process, a dye which is disposed on a transfer body is sublimated by heating and transferred to an image receiving sheet.

There is a disadvantage in the heat transfer process in that, when using a thermal head for image-wise heating, the temperature distribution tends to become uneven due to the variation in values of resistance at the head, which consequently leads to producing an uneven image. Further, because only the image portions are locally heated at a high temperature, deformation of the substrate at the heated portions may be caused and, as a result, wrinkles tend to be generated. Also, as a means for improving uniformity in an image, a laser light can be employed for the heating in the heat transfer process. In this process, however, problems such as high cost of the apparatus, and a tendency to cause unevenness in the final image due to the decomposition of materials such as dyes or the like by a localized instantaneous heating at high temperatures have not been solved.

In contrast with the aforementioned image forming processes, an ink jet system, in which an image is formed by discharging ink as droplets, is used as a non-contact image forming process which does not affect the image receiving sheet or colorants used for the image forming. There are various types of ink jet systems such as a piezo-type, a thermal-type, a Hertz-type, and the like. These methods are disclosed in detail in the Journal of Science and Technology, Vol. 42, No. 1 (1996, USA). Here, a piezo-type will be described. A piezo-type ink jet systems includes a plurality of nozzle holes which consist of ink heads disposed in parallel, an independent discharge cavity which communicates with said nozzle holes and a portion of a wall of which works as a diaphragm, a piezoelectric element mounted on the diaphragm, and a common ink cavity which supplies ink into the discharge cavity. In the ink jet system, an image is formed on the image receiving sheet by applying pulse voltage in accordance with image information to the piezoelectric element, so as to discharge ink droplets from the nozzle holes.

In the ink jet system, problems such as the above-stated deformation of the substrate or decomposition of the coloring material due to the heat during recording can be avoided. The selection of the image forming materials, however, has been narrowly restricted due to liquid properties of the ink in order to prevent the clogging of the nozzle and stably form uniform ink droplets. When forming color images, dyes or specific pigments must be selected so as to prevent the nozzle clogging. As a result, the hue reproducibility in the formed image is restricted. For example, the ink jet system has not been able to be applied to printers for high accuracy printing proofs which are required to reproduce the same hues as those of printed ink pigments. Furthermore, even if the limited materials are employed, the nozzles may clog when the printer is not used for a long period of time. Also, the formed image has very poor light resistance and water resistance so that the dye tends to smear on the image receiving sheet.

An image forming process utilizing this ink jet system is disclosed in Japanese Patent Application Laid-Open (JP-A) No.11-70633 in which an image is formed by the following steps: applying, by an ink jet device, droplets of a cross linking agent image-wisely to a recording layer comprising a cross linking material; cross-linking and curing the portions to which the cross-linking agent has been applied; and removing, by washing, materials from the portions at which no cross-linking was performed. In this process, a plate for so-called screen printing is formed by using an ink jet, and then an image is formed by using colored ink. This process requires complex processing in that it is composed of two processing steps of plate-making and printing, and in that a development processing is needed in the plate-making step which causes problems such as the disposal of waste cleaning liquid and the like.

In addition, there is a so-called transfer-type ink jet system (e.g., Japanese Patent Application Laid-Open (JP-A) No. 5-42755) in which an image, which is formed from a recording solution including a liquid and a coloring agent, is formed on an image carrier by an ink jet recording system, and the image is transferred onto a body on which an image is to be transferred. This transfer-type ink jet system is an ordinary ink jet recording system in which, for example, an image including a dye is recorded once on an image carrier on a drum, and the image is then transferred onto a body on which an image is to be transferred. The same problems as with general ink jet systems remain, such as the limitations on the coloring materials, clogging of the nozzles and the like. Further, it is easy for smearing to occur, and only low resolution images can be obtained.

As an ink jet recording method using a transfer medium, JP-A-7-145576 discloses an image forming method in which an ink jet ink is, by an ink jet recording device, discharged image-wisely onto a transfer medium having a liquid-reactive resin layer as the uppermost layer thereof, the transfer medium is set in close contact with an image support, and the transfer medium and the image support are heated and pressed such that the image portions are transferred. This method is particularly suitable to cases in which the image support is formed from cloth. For example, when the ink is a water-based ink, the liquid reactive resin layer is formed from an aqueous resin, and when the ink droplets are discharged, the portions to which the ink droplets are applied dissolve and become tacky (adhesive). Due to this tackiness, only the portions to which the ink droplets are applied are transferred at the time of heating and application of pressure, and images having fine detail can be formed by using an ink jet method even on cloth. However, this method is especially directed to cases where the image support is cloth, and an ink jet ink is used. Thus, in the same way as regular ink jet recording, there are problems such as the coloring materials are restricted, the nozzles clog, and the like. Moreover, transfer is non-uniform, and there is unevenness in the transferred image.

In addition, Japanese Patent Application Laid-Open (JP-A) No. 62-117782 discloses an image forming method as follows. A solvent is applied imagewisely to the surface of an image carrier by using an ink jet discharging system. Thereafter, an ink layer is set in contact with the top surface of the image carrier, and only the portions of the ink layer contacting the image-wise solvent are formed on the image carrier. However, in this method, as is described on page 4, upper right column, lines 7 through 16 of JP-A-62-117782, a solvent having the appropriate cohesion and adhesion is required, and it is therefore difficult to select a solvent. Further, a synthetic resin film is used as the image carrier, but a synthetic resin film does not have good solvent acceptability as does a binder coated layer. Thus, it is extremely difficult to stably obtained good transferability. Moreover, in this method, reproduction of fine dots is insufficient, and multicolor transfer images in particular cannot be obtained at a high resolution.

JP-A-7-276780 is an improvement on the image forming method of above JP-A-62-117782. In JP-A-7-276780, as a method of applying a solvent image-wise onto a body to be recorded, a method is used in which heat energy is applied in accordance with image information to a porous body impregnated with solvent, and the impregnated liquid is related onto the body to be recorded as a mist (extremely fine droplets) or as vapor. Since this method does not use an ink jet discharging system, there is no clogging or the like. However, other than this application of mist or vapor to the body to be recorded, this method of JP-A-7-276780 is similar to the technique disclosed in JP-A-62-117782, and thus, the same problems as those described above arise.

SUMMARY OF THE INVENTION

In view of the aforementioned, it is an object of the present invention to provide an image forming process which is able to form an image having good hue reproducibility, and which overcomes problems such as restrictions on the image forming materials and clogging of the nozzles which are drawbacks of an ink jet system, and which suppresses damage to the substrate caused by heat and unevenness of the image which are drawbacks of a heat transfer system, and to provide an image forming process in which, in addition to the above points, transferability of fine points is good and a transferred image having a high resolution can be obtained, and to provide an image forming apparatus used for these image forming processes and can efficiently form a uniform image.

The present inventors have conducted intensive studies, and have found that an image which is uniform and has a good hue reproducibility can be formed by image-wisely applying a liquid substance which improves transferability to a transfer material which is used for a conventional heat transfer system, and then performing ordinary transfer processing. Thus, the present inventors arrived at the present invention.

The image forming process of the present invention is an image forming process including the steps of: (a) providing an image transfer material having a transfer recording layer formed from a heat transfer material and an image receiving sheet having a binder-resin-containing image receiving layer; (b) image-wisely applying a transferability promoting material to one of the heat transfer material and the image receiving sheet to form a latent image; and (c) applying pressure and heat to the image transfer material to form an image on the image receiving material from the latent image.

In the process described above, it is preferable that the temperature of heat processing in said transferring step is greater than or equal to the transfer temperature of the latent image portion and less than or equal to the transfer temperature of the heat transfer material. Further, it is preferable that the transferability promoting material which is used in the process is a composition which contains water and a nonionic surfactant. Further, it is preferable that the transferability promoting material used herein includes water and an organic solvent which is compatible with water and whose boiling point under normal temperature and normal pressure is 100° C. or more. Further, in another aspect of the present invention, the image forming process of the present invention includes, in addition to the above steps, a step of transferring a transfer image, which has been formed on the image receiving sheet, onto another support.

In accordance with another aspect, the present invention is an image forming apparatus for use with a transferability promoting material and, an image transfer material having a transfer recording layer and a heat transfer material, and an image receiving sheet which has a binder-resin-containing image receiving layer and on which an image is formed, the apparatus comprising: (a) a droplet discharge head which image-wisely discharges droplets of transferability promoting material for lowering a transfer temperature of the heat transfer material onto one of the transfer recording layer and the image receiving sheet; and (b) a pair of pressure rollers for pressing the image transfer material and the image receiving sheet against one another, at least one of the rollers including a heater for applying heat. From the standpoint of operation, the image forming apparatus described above preferably further includes a peeling member for peeling the image forming material from the image receiving sheet after passing between the pressure rollers.

DESCRIPTION OF THE PREFERRED EMBODIMENTS

Figure 1:
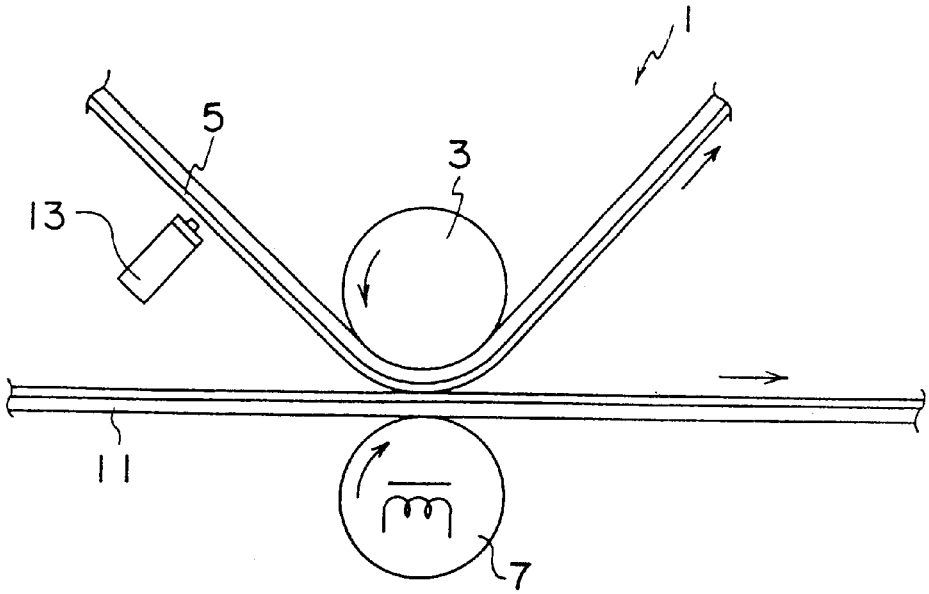
FIG. 1 is a schematic view showing an embodiment of the image forming apparatus relating to the present invention.

The present invention will be described in detail hereinafter.

The image forming process relating to the present invention for forming a transfer image image-wisely on an image receptor comprises the following steps: (1) preparing an image receiving sheet which has a binder-resin-containing image receiving layer, and an image transfer material which is formed by coating a transfer recording layer comprising a heat transfer material on a substrate; (2) forming a latent image by image-wisely discharging a liquid material which improves transfer sensitivity (in other words, droplets of liquid transferability promoting material which can lower the transfer temperature of the heat transfer material) on one of the transfer recording surface of the image transfer material or the image receiving surface of the image receiving sheet; (3) making the transfer recording layer of the image transfer material and the image receiving surface of the image receiving sheet tightly contact each other with the formed latent image therebetween; (4) passing these closely-contacting transfer recording layer and image receiving sheet through pressure rollers which are heated to a temperature at which latent image formed portions can be transferred by the material which improves the transfer sensitivity, the temperature being lower than a temperature at which the portions where no latent image is formed are transferred by the material which improves the transfer sensitivity; and (5) peeling the image transfer material from the image receptor. In the image forming process described above, an image is formed at the surface of the image receptor by separating the transfer material from the substrate only at the portions which the latent image is formed, so as to perform the transfer.

Examples of liquid transferability promoting materials in the present invention which can lower the transfer temperature of the heat transfer material include, for example, water, organic solvents, surfactants, and the like. Of these, organic solvents which can freely mix with water at room temperature, surfactants which can mix with water, and mixtures thereof are preferable.

It is preferable that the transferability promoting material does not contain any solid pigments or compounds which deposit over time, from the standpoint of stability over time and probability of clogging of the nozzles. Furthermore, when using a coloring material in the transfer recording layer, it is preferable, from the standpoint of not affecting the color tone, to employ materials that do not chemically act on the coloring material and do not react to form color when energy, for example, overheating or the like, is applied thereto. The transfer recording material itself is preferably colorless or pale-colored so as not to affect the color tone.

Examples of the organic solvents which freely mix with water include: monohydric or polyhydric alcohols such as methanol, ethanol, propanol, ethylene glycol, diethylene glycol, triethylene glycol, polyethylene glycol, propylene glycol, polypropylene glycol, glycerin, and the like; ethers such as ethylene glycol monomethyl ether, ethylene glycol monobutyl ether, propylene glycol monobutyl ether, triethylene glycol monobutyl ether, tripropylene glycol monomethyl ether, and the like; ketones such as acetone, methyl ethyl ketone, methyl isobutyl ketone, and the like.

Surfactants which freely mix with water can be anionic, cationic, nonionic, and ampholytic surfactants, any of which can be arbitrarily selected in accordance with characteristics of the heat transfer material which is used. These surfactants can be utilized at a concentration in a range that can be dissolved in water. Examples of surfactants include: fatty acid salts, alkyl sulfuric acid ester salt, polyoxyethylene alkyl ether sulfuric acid ester salt, alkyl benzenesulfonic acid, alkyl naphthalenesulfonic acid salt, alkyl sulfosuccinate salt, alkyl diphenyl ether disulfate, alkyl phosphate, naphthalene sulfonic acid formalin condensate, polyoxyethylene alkyl ether, polyoxyethylene alkylene alkyl ether, polyoxyethylene fatty acid ester, polyoxyethylene alkylamine, alkyl alkanolamine, alkyl amine salt, alkyl betaine, and the like.

For jetting the transferability promoting material in droplets, the above-mentioned materials can be selected in accordance with the characteristics of the heat transfer material which uses the materials. These transferability promoting materials may be used alone, or two or more types may be used in combination. Of these, it is preferable from the standpoint of efficiency that hydrophilic organic solvents or surfactants or appropriate combinations thereof are used in a mixture with water. In preparing a liquid composition for the transferability promoting materials, for the purposes of controlling the dischargeability, improving the storage stability of the liquid, preventing the diffusion of the jetted droplets, and the like, a surface tension adjusting agent, antifungal agent, viscosity adjusting agent, pH adjusting agent, antifoaming agent, or the like can be used within ranges that do not adversely affect the effects of the present invention.

The transferability promoting material is used in order to improve the transferability at an arbitrary part of the transfer recording layer comprising the heat transfer material, thus enabling easy and complete transfer at a lower transfer temperature. The transferability promoting material penetrates into at least one portion of the transfer recording layer or the image receiving layer, and facilitates peeling of the transfer recording layer from the support. The transferability promoting material is preferably a liquid having surface tension in the range of from 20 to 60 mN/m and viscosity of less than or equal to 50 mPa·s. The amount of the transferability promoting material provided to the transfer recording layer or the image receiving layer is preferably kept within a range which will not lower the resolution of the transferred image. When the amount becomes too great, the transferability promoting material penetrates into the transfer recording layer at the interfaces between the image portions and non-image portions, such that the transfer recording layer dissolves or becomes fluid, which results in a lowering of the resolution at the interfaces of images.

As a standard for lowering the transfer temperature, a transferability promoting material is preferably used which lowers the transfer temperature by at least 3° C. relative to the original transfer temperature of the transfer recording layer. The function of the transferability promoting material is to swell or make plastic the binder resin contained in the transfer recording layer or the image receiving layer.

The transfer temperature can be measured by the following method.

As shown in FIG. 1, a device equipped with a pair of heating nip rollers including a heating roller with variable temperature is utilized to measure the transfer temperature. After inserting a thermocouple between the transfer material and the image receiving sheet, the temperature is measured by the thermocouple as it passes through the heating nip rollers. The lowest transfer temperature at which transfer is performed is determined by repeatedly carrying out measurement while varying the temperature each time.

In the image forming method of the present invention, when a solution containing a nonionic surfactant and water is used as the transferability promoting material, the effect of reducing the transfer temperature is great. Further, because the transferability of fine points is good, a transfer image having high resolution can be obtained. Although the reason for this is not altogether clear, it is thought that because the wettability and permeability of the transferability promoting material with respect to the transfer layer and the image receiving layer are good, a latent image of fine dots can be formed sharply, and further, when the transferability promoting material penetrates into the transfer layer or the image receiving layer, the effect of the transferability promoting material as a plasticizer with respect to the resins contained in the layer is good, and as a result, adhesiveness of the portions at which the latent image is formed is exhibited due to heating, thereby resulting in the transfer effect. Further, it is also thought that the nonionic surfactant which has penetrated has the effect of orienting the coated layer and the substrate of the transfer layer at the interface, and accelerating the peeling transfer.

Water is contained in the solution in an amount of about 5 to 95% by weight. Further, it was found that if nonionic compounds in which an ethyleneoxide group is added as a hydrophilic group are used as the nonionic surfactant, the effect of lowering the transfer temperature of the latent image formed portions is great, and further, a high resolution can be obtained. Examples of the nonionic compounds include compounds represented by following general formulas 1 through 4.

$$R—O—(CH_2CH_2O)_nH$$ General Formula 1

General Formula 2

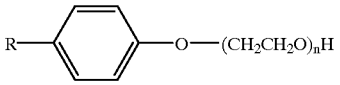

General Formula 3

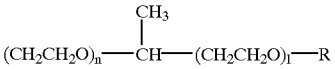

General Formula 4

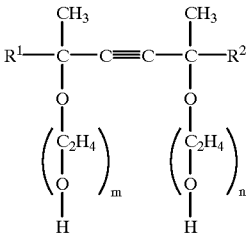

In above general formula 1, R represents an alkyl group or an alkylene group, and n represents an integer of from 2 to 30, preferably of from 2 to 20. In general formula 2, R represents an alkyl group, and n represents an integer of from 2 to 30, preferably from 2 to 20. In general formula 3, R represents an alkyl group, and n and 1 each represent an integer of from 2 to 30, preferably of from 2 to 20. Further, in general formula 4, $R_1$ and $R_2$ represent a hydrogen atom or an alkyl group, and m and n each represent an integer of from 2 to 30, preferably an integer of from 2 to 20.

Further, in the above general formulas 1 through 4, the number of added ethylene oxides is preferably from 2 to 30, and more preferably from 2 to 20.

Specific examples of the compounds represented by general formulas 1 through 4 are polyoxyethylene(4)laurylether, polyoxyethylene(7)cetylether, polyoxyethylene(13) stearylether, polyoxyethylene(5)oleylether, polyoxyethylene (10)nonylphenylether, ethyleneoxide-propyleneoxide copolymer (n=10, l=7), ethyleneoxide additives (n+m=10) of acetyleneglycol, and the like. However, the compounds of general formulas 1 through 4 are not limited to these examples.

The nonionic surfactant is added into the discharge solution in an amount of 0.1 to 20% by weight, and preferably 0.1 to 10% by weight. If the added amount exceeds 20% by weight, the resolution tends to deteriorate. Further, if the added amount is less than 0.1% by weight, it is difficult to obtain the effect of promoting transferability.

In addition to the nonionic surfactant, water-soluble organic solvents may be added as needed. Examples of water-soluble organic solvents are the previously-listed examples of organic solvents which can be freely blended in with water. An appropriate amount of the water-soluble organic solvent contained in the solution is about 0 to 90% by weight. In particular, as the contained amount of solvent having a boiling point of 100° C. or more increases, the discharge stability at the time of forming the latent image improves, but the dryability of the transfer image deteriorates. The optimal type of solvent and amount thereof used are determined in accordance with the necessity of drying the transfer body and the drying capabilities of the device.

Further, in order to provide dischargeability and storage stability of the solution, surface tension adjusting agents, antifungal agents, viscosity adjusting agents (e.g., polymers), pH adjusting agents, antifoaming agents, and the like may also be added.

In the image forming method of the present invention, for the transferability promoting material, a solution is used which includes water and an organic solvent which is compatible with water and has a boiling point of 100° C. or more under normal temperature and normal pressure. In this way, because the discharge stability of the solution improves, the phenomenon of the solution not discharging at the time of forming the latent image and at the time of starting up operation again after a standby state can be prevented. Further, because the transferability of fine dots improves, a transfer body having a high resolution can be obtained.

Examples of the organic solvent which is compatible with water and has a boiling point of 100° C. or more under normal temperature and normal pressure are monovalent or polyvalent alcohols such as ethyleneglycol, diethyleneglycol, thiodiethyleneglycol, triethyleneglycol, polyethyleneglycol, propyleneglycol, polypropyleneglycol, and glycerin; ethers such as ethyleneglycolmonomethylether, ethyleneglycolmonoethylether, ethyleneglycolmonobutylether, diethyleneglycolmonomethylether, diethyleneglycolmonoethylether, ethyleneglycoldiethylether, propyleneglycolmonomethylether, propyleneglycolmonoethylether, propyleneglycolmonobytylether, triethyleneglycolmonoethylether, triethyleneglycolmonobutylether, and tripropyleneglycolmonomethylether; ketoalcohols such as diacetonealcohol; nitrogen-based solvents including N-methyl-2-pyrolidone, 2-pyrolidone; and the like.

These organic solvents are contained in the solution in an amount of 1 to 90% by weight. If the contained amount exceeds 90% by weight, the discharge stability at the time of latent image formation is good, but the dryability of the transfer image tends to be poor. Further, if the contained amounts is less than 1% by weight, it is difficult to obtain improvements in discharge stability and transferability of fine dots. The optimal amount is determined in accordance with the necessity of drying the transfer body and the drying capability of the device.

In addition to the above-described organic solvents, the previously-described organic solvents which can be freely blended with water and the above-described surfactants can also be added into the material for lowering the transfer temperature. Further, in order to improve the dischargeability and storage stability of the solution, surface tension adjusting agents, antifungal agents, viscosity adjusting agents (e.g., polymers), pH adjusting agents, antifoaming agents, and the like may also be added.

The image transfer material and the image receiving sheet utilized in the method of the present invention will be described hereinafter. The image transfer material of the present invention is formed by coating a transfer recording layer comprising a heat transfer material on a substrate. Detailed descriptions of the substrate and the transfer recording layer which form the image transfer material, as well as other layers which are provided if desired will be given hereinafter.

Substrate

The material for the substrate of the image transfer material is not particularly limited. Therefore, various materials can be used in accordance with the purposes. Preferred examples of the material for the substrate include synthetic resin materials such as polyethylene terephthalate, polyethylene-2,6-naphthalate, polycarbonate, polyethylene, polyvinyl chloride, polyvinylidene chloride, polystyrene, styrene/acrylonitrile copolymers, and the like. Among these materials, biaxially oriented polyethylene terephthalate is preferable from the standpoints of mechanical strength and dimensional stability with respect to heat.

In order to improve the tight fitting of the substrate to the transfer recording layer to be disposed on the substrate, it is preferable to carry out a surface roughening treatment of the substrate and/or to form on the substrate one layer or two or more primer layers. Examples of the surface roughening treatment include a glow discharge treatment, a corona discharge treatment, and the like. Preferable as a material for the primer layer is a material that exhibits good adhesiveness to surfaces of both the substrate and the transfer recording layer, has a low thermal conductivity and has excellent heat resistance. Examples of such materials for the primer layer include styrene, styrene/butadiene copolymer, gelatin, and the like. The total thickness of the primer layer is ordinarily in the range of from 0.01 to 2 $\mu$m. In addition, if necessary, a surface of the heat transfer sheet of a side opposite to a side having the transfer recording layer may be provided with any of various functional layers, such as a releasing agent layer or the like, or may be surface-treated.

Transfer Recording Layer

The transfer recording layer contains, when used to form a colored image, at least a pigment to be transferred to the image receiving sheet to form a colored image, and a binder resin for forming the layer, and other components if desired. In the present invention, however, the transfer recording layer is not necessarily limited to a colored recording layer, and may include, for example, an achromatic resin layer or the like for forming a planographic printing plate or the like, as long as such an achromatic resin layer has the property of improving the transferability due to the addition of the above-described liquid transferability promoting material.

Pigments can be classified roughly into organic pigments and inorganic pigments. Organic pigments provide highly transparent films, while inorganic pigments are generally excellent in concealability. Therefore, pigments of either of these types can be properly used in accordance with the purposes. When the image transfer material of the present invention is used as a color proof for printed color correction, organic pigments are suitably used whose hues are identical or close to yellow, magenta, cyan and black, which are generally used in printing ink. In addition to these pigments, metal powders, fluorescent pigments, and the like may also be used. Examples of the pigments suited for use in the transfer recording layer include azo-based pigments, phthalocyanine-based pigments, anthraquinone-based pigments, dioxazine-based pigments, quinacridone-based pigments, isoindolinone-based pigments and nitro-based pigments. Typical pigments for use in the transfer recording layer are listed below according to hue, but the present invention is not limited to these pigments.

1)Yellow Pigments

HANSA YELLOW G, HANSA YELLOW 5G, HANSA YELLOW 10G, HANSA YELLOW A, PIGMENT YELLOW L, PERMANENT YELLOW NCG, PERMANENT YELLOW FGL, PERMANENT YELLOW HR

2)Red Pigments

PERMANENT RED 4R, PERMANENT RED F2R, PERMANENT RED FRL, LAKE RED C, LAKE RED D, PIGMENT SCARLET 3B, BORDEAUX 5B, ALIZARIN LAKE, RHODAMINE LAKE B

3)Blue Pigments

PHTHALOCYANINE BLUE, VICTORIA BLUE LAKE, FAST SKY BLUE

4)Black Pigments

CARBON BLACK

Preferable examples of the binder resin contained in the transfer recording layer are amorphous organic polymers having a softening point from 40 to 150° C. Examples of the amorphous organic polymers include, for example, butyral resins; polyamide resins; polyethyleneimine resins; sulfonamide resins; polyesterpolyol resins; petroleum resins; homopolymers or copolymers of styrene, derivatives thereof or substituted styrene, such as styrene, vinyltoluene, $\alpha$-methylstyrene, 2-methylstyrene, chlorostyrene, vinylbenzoic acid, sodium vinylbenzenesulfonate soda, and aminostyrene; homopolymers of vinyl monomers such as methacrylates or methacrylic acid (such as methyl methacrylate, ethyl methacrylate, butyl methacrylate, and hydroxyethyl methacrylate), acrylates or acrylic acid (such as methyl acrylate, ethyl acrylate, butyl acrylate, and $\alpha$-ethylhexyl acrylate), dienes (such as butadiene and isoprene), acrylonitrile, vinyl ethers, maleic acid, maleic acid esters, maleic anhydride, cinnamic acid, vinyl chloride, and vinyl acetate, as well as copolymers of such homopolymers and other homopolymers. These resins may be used in a combination of two or more.

In the present invention, the transfer recording layer comprises preferably 30 to 70% by weight, and more preferably 30 to 50% by weight, of pigment, and comprises preferably 70 to 30% by weight, more preferably 70 to 50%, by weight, of resin.

When a multi-color image is formed by repeatedly superposing multiple image layers (transfer recording layers on which the images have been formed) on the same image receiving sheet, the transfer recording layer preferably contains a plasticizer in order to enhance the adhesion between images. Examples of the plasticizer include phthalic esters such as dibutyl phthalate, di-n-octyl phthalate, di-(2-ethylhexyl)phthalate, dinonyl phthalate, dilauryl phthalate, butyl lauryl phthalate, butyl benzyl phthalate, and the like; aliphatic dibasic acid esters such as di-(2-ethylhexyl) adipate, di-(2-ethylhexyl)sebacate, and the like; phosphoric triesters such as tricresyl phosphate, tri-(2-ethylhexyl) phosphate, and the like; polyol polyesters such as polyethylene glycol ester and the like; and epoxy compounds such as epoxy fatty acid ester and the like. In addition to the above conventional plasticizers, acrylic esters such as polyethylene glycol dimethacrylate, 1,2,4-butanetriol trimethacrylate, trimethylolethane triacrylate, pentaerythritol triacrylate, pentaerythritol tetraacrylate, dipentaerythritol-polyacrylate may be suitably used in accordance with the type of binder employed. These plasticizers may be used as mixtures of two or more plasticizers.

Generally, the plasticizer is used in the transfer recording layer such that the weight ratio of the total amount of the pigment and the resin to the amount of plasticizer is from 100:1 to 100:3, and preferably from 100:1.5 to 100:2. Further, a surfactant, a thickener and the like may be added to the transfer recording layer as occasion demands.

The transfer recording layer can be provided by preparing the application liquid which is made by dissolving or dispersing a pigment, above-mentioned binder resin, and the like, applying the application liquid to the substrate (on the primer layer formed on the substrate), and then drying. Examples of the solvents utilized in the preparation of the application liquid include n-propyl alcohol, methyl ethyl ketone, propylene glycol mono methyl ether (MFG), methanol, and the like. Application and drying can be performed using ordinary methods for application and drying.

The thickness (dry layer thickness) of the transfer recording layer is from 0.1 to 1.5 $\mu$m, and preferably from 0.3 to 1.0 $\mu$m.

When a latent image is formed by applying the transferability promoting material image-wisely to the surface of the transfer recording layer of the image transfer material which is formed by laminating the transfer recording layers in the above-stated order on a substrate, or on the surface of the image receiving sheet which will be described later, the transferability promoting material contained in the heat transfer material that composes of the transfer recording layer penetrates the transfer recording layer only at the portions of the latent image where the transferability promoting material has adhered. The bonds of the binder which forms the layer are weakened, and the bonding strength between the substrate and the image forming layer is also weakened, which improves transferability onto the image receiving sheet. In this way, transferring at a lower temperature is enabled.

[Image Receiving Sheet]

As the image receiving sheet which can be used in the process of the present invention, usually, an image receiving sheet is preferable which includes a substrate, one or more image receiving layers containing a binder resin and disposed on the substrate, and if desired, one or more layers of a cushion layer, peeling layer, or intermediate layer between the substrate and the image receiving layer. However, resin sheets such as polyethylene terephthalate (PET) and the like, plain paper, coated paper, glass epoxy sheets and metal plates can also be utilized as long as they have good affinity with above-described transfer recording layer. When an image receiving sheet which is formed by providing an image receiving layer on a substrate is utilized, a back layer is preferably provided, for improved conveying, on the surface of the substrate opposite to that on which the image receiving layer is provided.

The substrate may be an ordinary substrate in the form of a sheet, such as a plastic sheet, a metal sheet, a glass sheet, paper, or the like. Examples of the plastic sheet include polyethylene terephthalate sheets, polycarbonate sheets, polyethylene sheets, polyvinyl chloride sheets, polyvinylidene chloride sheets, polystyrene sheets, styrene/acrylonitrile copolymer sheets, polyester sheets, and the like. Examples of the paper substrate include printing paper, coated paper, and the like.

It is preferable that the substrate be provided with fine voids, which enable prevention of curling and an improvement in image quality. Such a substrate can be prepared in the following manner: mixing a thermoplastic resin, a filler such as a polymer incompatible with inorganic pigments or above-mentioned thermoplastic resins, and the like so as to form a mixed melt; forming a single-layer or a multi-layered film by extruding the obtained mixed melt by a fusing extruder; and stretching the film uniaxially or biaxially. The percentage of voids is determined by such factors as selection of the resin and the filler, the mixing ratio, the conditions of stretching, or the like.

The above-mentioned thermoplastic resins may preferably be polyolefine resins such as polypropylene, or polyethylene terephthalate resins because of their good crystallizability, good stretchability, and facilitation of formation of voids. It is preferable to employ a polyolefine resin or a polyethylene terephthalate resin as the principal component, and use together therewith other thermoplastic resins in properly small amounts. Examples of the above-mentioned inorganic pigments used as a filler include calcium carbonate, clay, diatomaceous earth, titanium oxide, aluminum hydroxide, silica, and the like, each of which preferably has an average grain size in the range of from 1 $\mu$m to 20 $\mu$m. A suitable example of the incompatible resin additionally used as the filler, when using polypropylene as the thermoplastic resin, is polyethylene terephthalate.

Ordinarily, the content of the filler such as the inorganic pigment is in the range of from 2 to 30 percent in volume percentage of the substrate.

The thickness of the substrate of the image receiving sheet is usually in a range of from 10 to 400 $\mu$m, and preferably in a range of from 25 to 200 $\mu$m. In order to improve the tight contact between the substrate surface and the image receiving layer (or a cushion layer) or between the substrate surface and the image forming layer of the heat transfer sheet, the surface of the substrate may be treated by, for example, a glow discharge treatment or a corona discharge treatment.

It is preferable to form one or more image receiving layers on the substrate in order to transfer and fix the image forming layer to the surface of the image receiving sheet. Preferably, the image receiving layer is a layer formed mainly of a binder resin composed of an organic polymer, and the binder resin is preferably a thermoplastic resin. Examples of the resin include: homopolymers or copolymers of acrylic monomers such as acrylic acid, methacrylic acid, acrylates, and methacrylates; cellulosic polymers such as methyl cellulose, ethyl cellulose, and cellulose acetate; homopolymers and copolymers of vinyl-based monomers such as polystyrene, polyvinylpyrrolidone, polyvinyl butyral, polyvinyl alcohol, and polyvinyl chloride; polymers formed by condensation such as polyesters and polyamides; and rubber-based polymers such as butadiene/styrene copolymers. In order to obtain an appropriate adhesive strength between the image receiving layer and the image forming layer, the binder of the image receiving layer is preferably a polymer whose glass transition temperature (Tg) is less than 90° C. In addition, it is possible for the purpose of adjusting the glass transition temperature of the image receiving layer to add a plasticizer to the image receiving layer. The Tg of the binder polymer is preferably 30° C. or above in order to prevent blocking between the sheets. Especially preferable examples of binder polymers of the image receiving layer are the same or similar binder polymers as those for the image forming layer, in that such polymers can improve the tight contact with the image forming layer during transfer recording, and improve sensitivity and image strength.

The image receiving layer is a layer formed by applying onto a support an aqueous liquid (an aqueous solution, a water dispersed solution) or an organic solvent solution containing a binder resin. Thus, the image receiving layer receives (accepts) the transferability promoting material, unlike a support made of a plastic sheet or the like. Here, "receives" or "accepts" means that the image receiving layer is, for example, made plastic or made to swell by the transferability promoting material. Due to this effect of being made plastic or being made to swell, the transfer temperature of the transfer material can be lowered.

In accordance with the present invention, images can be transferred to printing paper or the like, after being formed on the image receiving layer.

The thickness of the image receiving layer is in the range of from 0.3 to 7 $\mu$m, and preferably from 0.7 to 4 $\mu$m. If the thickness of the image receiving layer is 0.3 $\mu$m or less, the layer tends to be torn easily during transfer onto printing paper due to insufficient strength of the layer. On the other hand, if the image receiving layer is made too thick, the gloss of the image after being transferred onto printing paper is increased, which deteriorates the similarity to the printed image.

The image forming process of the present invention is carried out by using the above-described image transfer material, image receiving sheet and transferability promoting material.

Next, an image forming apparatus relating to the present invention will be described with reference to the appended figures, and at the same time, the respective steps of image forming process will be described.

FIG. 1 is a schematic view showing the structure of the image forming apparatus relating to the present invention.

The image forming apparatus 1 includes a discharge head 13 for application of droplets of the transferability promoting material to an image transfer material 5, and a pair of pressure rollers which are a supporting drum 3 for making the image transfer material 5 and an image receiving sheet 11 tightly contact each other to carry out transfer, and a pinch roller 7 which includes a heating means. The image transfer material (toner sheet) 5 which is formed by forming a transfer recording layer on a substrate is supported by the supporting drum 3 such that the image transfer material 5 is trained about a portion of the periphery of the supporting drum 3. In the transfer recording layer formed on the substrate, materials such as a pigment-based toner or metallic particles, and a binder resin and the like are contained. The present embodiment will be described by using as an example a case in which a pigment-based toner is used as the transfer material.

The image transfer material 5 is supported by the supporting drum 3 such that the substrate side of the image transfer material 5 contacts the supporting drum 3 and the transfer recording layer side is the surface side. In the image forming apparatus 1, the pinch roller 7, the coaxial direction of which the same as that of the supporting drum 3, is disposed so as to face the supporting drum 3. Inside the pinch roller 7 is built a heater which can control the temperature of the pinch roller 7.

Between the supporting drum 3 and the pinch roller 7 is inserted an image receiving sheet 11. The image transfer material 5 and the image receptor 11 are superimposed with each other such that the transfer recording layer and the image receiving surface of the image receiving sheet 11 closely contact each other between the supporting drum 5 and the pinch roller 7. The superposed image transfer material 5 and image receiving sheet 11 are inserted between the pressure rollers, and moved toward the right in FIG. 1 by the rotation of the supporting drum 3 and the pinch roller 7 while being heated. In the present embodiment, a case is described in which an image receiving sheet which has a PET film as a substrate is used.

The portions where the latent image is formed by the transferability promoting material has a lower transfer temperature relative to the other portions of the transfer recording layer. For the heating condition of the pinch roller 7 at this time, if the temperature at the portions of contact between the latent image formed portions and the image receiving layer is set to be in a range below the original transfer temperature of the transfer recording layer and above the transfer temperature of the latent image formed portions, image transfer resulting in clear distinction between the latent image formed portions and portions where no latent image is formed (portions where no transferability promoting material has adhered) can be achieved. The heating temperature is preferably in the range below the transfer temperature of the transfer recording layer and above the transfer temperature of the latent image portions.

In the image forming apparatus 1, a droplet discharge head 13 is disposed facing the supporting drum 3. The droplet discharge head 13 is disposed so as to be freely movable along the transverse direction of the image transfer material via a traveling rail (not shown) or the like. The traveling direction of the droplet discharge head 13 is made to be the main scanning direction for image forming.

The droplet discharge head 13 image-wisely discharges droplets comprising the liquid transferability promoting material to form a latent image on the surface of the image transfer layer of the image transfer material 5 which is supported by the supporting drum 3. With regard to the structure of the droplet discharge head 13, ink heads which have the same structure as that of ink heads used in known general ink jet printing apparatuses can be employed.

When forming a multi-color image using the apparatus, an image is formed by image transfer materials using respective colors of black (K), cyan (C), magenta (M) and yellow (Y) as coloring materials contained in the transfer recording layer of the image transfer material.

For the image transfer material 5 of the black (K) color, droplets of the transferability promoting material are discharged image-wisely from the droplet discharge head 13 so as to form a latent image on the transfer recording layer of the image transfer material 5. This process is called a latent image forming process.

Then, the transfer recording layer of the image transfer material 5 on which the latent image is formed and the image receiving surface of the image receiving sheet 11 are superposed so as to closely contact one another, and are pressed by the supporting drum 3 and the pinch roller 7. At this time, by controlling the heating means inside the pinch roller 7 so as to heat the entire surfaces of the image receiving sheet 11 and the image transfer material 5 under predetermined conditions, only the latent image formed portions at which the transferability promoting material has image-wisely adhered are transferred image-wisely to the surface of the transfer sheet 11. This process is called a transfer process.

Then, by winding and conveying the image transfer material 5 along the supporting drum 3 in the circumferential direction thereof, the image transfer material 5 is peeled from the image receiving sheet 11, and a black image is formed on the surface of the image receiving sheet 11.

A full-color image in which the four colors are superposed is formed by using respective image transfer materials 5 of cyan, magenta and yellow colors in the same manner as that described above, and sequentially transferring and fixing the transfer recording layer of each color on the same image receiving sheet 11 in accordance with the image information.

In this way, in accordance with the image forming process using the above-described image forming apparatus 1, by heating the image transfer material 5 and the image receiving sheet 11 at the entire surfaces thereof, the transferability of only the latent image portions to which the transferability promoting material has adhered can be improved, and only the latent image portions are selectively transferred and fixed to the transfer sheet 11. Thus, a uniform image can be formed without unevenness in the thermal conduction due to unevenness in the values of resistance of the thermal head, unevenness in contact, and unevenness in the thickness of the substrate, which often occur in conventional peeling transfer processes.

Because a pigment-based toner is used in the transfer recording layer, there is no need to select the pigments or the dyes in accordance with restrictions on the properties such as in the case of inks in an ink jet recording system. Any of a wide range of pigment-based toners can be selected, a desired hue can be selected, and the hue reproducibility is excellent. At the same time, images having good durability, and images having desired hues and functions can be formed, since any of pigments having good light resistance, metal pigments, functional pigments and the like can be arbitrarily selected. Therefore, the present image forming process can be suitably adapted to color proofs or the like where the hue reproducibility is regarded as important.

Another aspect of the image forming apparatus of the present invention will be explained below.

Figure 2:
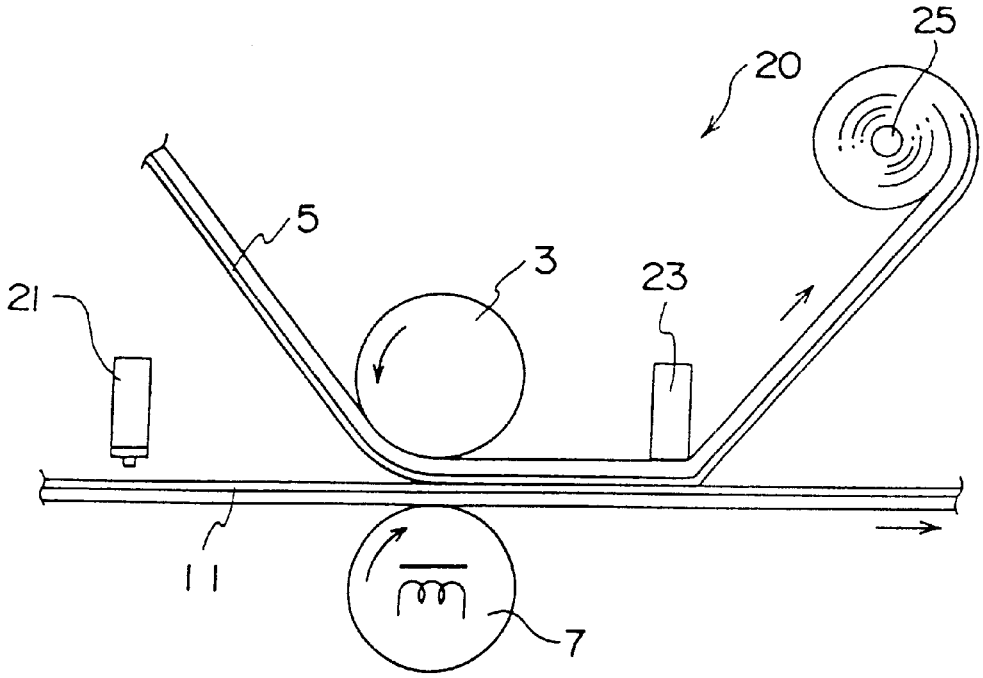
FIG. 2 is a schematic view showing an embodiment in which a discharge head of the image forming apparatus relating to the present invention is directed toward an image receiving sheet.

FIG. 2 shows a second structure of the image forming apparatus relating to the present invention.

The image forming apparatus 20 includes a discharge head 21 which applies the liquid transferability promoting material to the surface of the image receiving sheet 11; a pair of pressure rollers which are the supporting drum 3 for making the image transfer material 5 and the image receiving sheet 11 closely contact each other to carry out transfer, and the pinch roller 7 provided with a heating means; and a peeling bar 23 for peeling the image transfer material 5 and the image receiving sheet 11 which are in close contact and for which transfer processing has been completed.

In the image forming apparatus 20 in accordance with the present embodiment, a peeling bar 23 is disposed at the conveying direction downstream side of the supporting drum 3 and presses the image transfer material 5 toward the image receiving sheet 11 side. The image transfer material 5 is taken up, at a predetermined tensile force, between the peeling bar 23 and a taking-up means 25 of the image transfer material 5. Furthermore, the image transfer material 5 after passing by the peeling bar 23 is peeled at an approximately right angle with respect to the image receiving sheet 11.

In accordance with the thus-constructed image forming apparatus 20, because the substrate of the image transfer material 5 is bent at an approximately right angle at the peeling bar 23, the peeling of the substrate from the transfer body is promoted due to the difference in the bend radiuses, which enables improved fixing of the transfer recording layer to the surface of the image receiving sheet 11.

In the image forming apparatus 20, a droplet discharge head 21 is disposed facing the supporting drum 3. The droplet discharge head 21 is disposed so as to be freely movable in the transverse direction of the image receiving sheet 11. In the present embodiment, the image forming apparatus has the same configuration as that of above-described image forming apparatus 1 except that the discharge head 21 discharges droplets in the direction of the image receiving sheet 11, and that the image forming apparatus is provided with the peeling bar 23 for stably peeling the image transfer material 5 from the image receiving sheet 11. The droplet discharge head 21 discharges the droplets of the transferability promoting material image-wisely on the surface of the image receiving sheet 11 so as to form a latent image. The image receiving sheet 11 is in tight contact with the surface of the transfer recording layer of the image transfer material 5 which is supported by the supporting drum 3, and improves the transferability of the transfer recording layer at the latent image formed portions.

In the present embodiment, because the transferability promoting material is discharged onto the image receiving sheet 11 and not onto the transfer recording layer, a lowering of the positional accuracy of the latent image due to problems involved in the discharging can be suppressed even when a thin transfer recording material is employed.

In this way, in the image forming process of the present invention, an image is formed by first forming an image-wise latent image by the transferability promoting material and then transferring and fixing the transfer recording layer itself at the latent image portions thereof to the image recording sheet 11 to form an image. Thus, an image having good resolution and hue reproducibility can be formed without concern for the bleeding of ink, as compared with images formed by discharged ink. Further, as described before, the latent image formed by the transferability promoting material has the same effect when formed either on the surface of the transfer recording layer of the image transfer material 5 or on the image receiving surface of the image receiving sheet.

A modified example of the image forming apparatus of the present invention will be described hereinafter.

Figure 3:
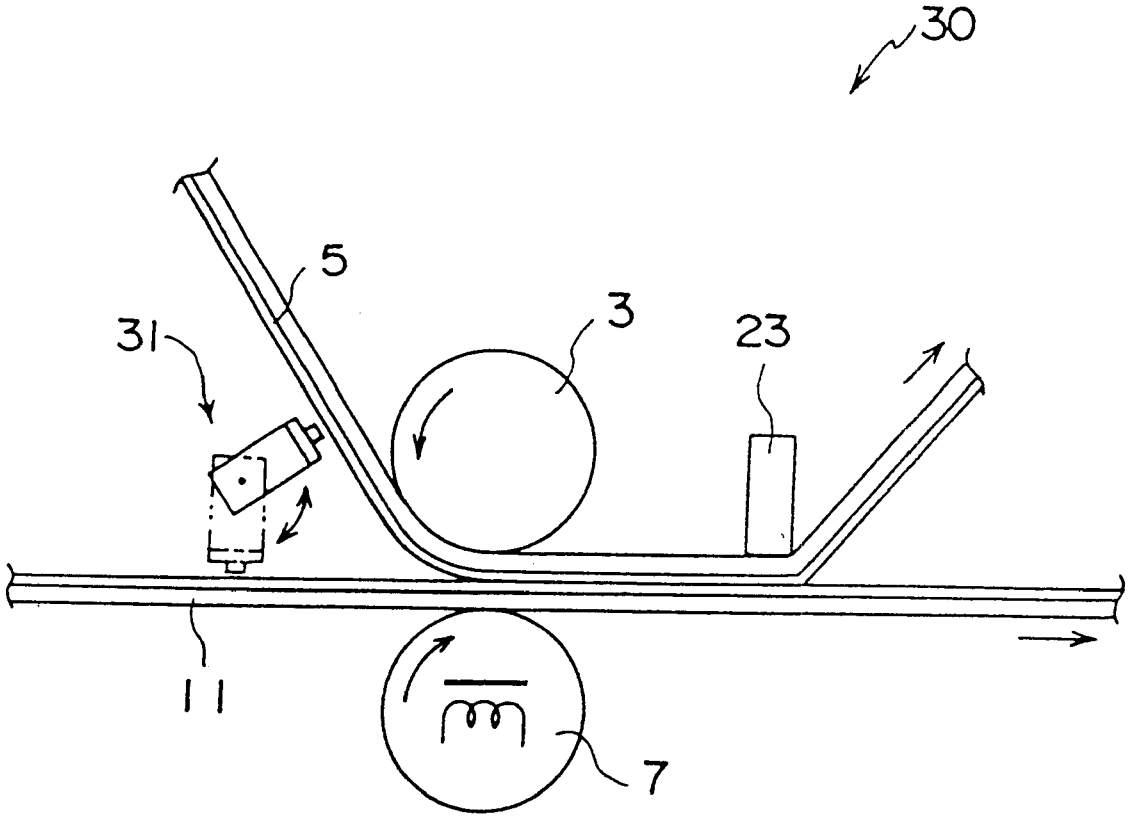
FIG. 3 is a schematic view showing an embodiment in which the discharge head of the image forming apparatus relating to the present invention is disposed such that the direction thereof can be switched.

In an image forming apparatus 30 relating to the present invention, as shown in FIG. 3, the droplet discharge head is disposed such that the discharging direction thereof can freely be switched between a direction toward the image transfer material 5 and a direction toward the image receiving sheet 11. The direction in which the droplets are discharged can be changed in accordance with the materials used and the transfer conditions.

Examples of the structure for switching the direction of the droplet discharge head 31 include a structure in which the droplet discharge head 31 with a single or a plurality of discharge hole(s) is rotatably provided (the arrangement shown in FIG. 3), and a structure in which the discharge holes are formed in the droplet discharge head 31 in each of the directions, and opening and closing of the openings is controlled as needed, and the like.

In accordance with the image forming apparatus 30, a latent image can be formed by switching the droplet discharging direction of the droplet discharge head 31 toward the appropriate one image forming surface, on the basis of compatibility of the droplets and the image transfer material 5 or the image receiving sheet 11 which is being used.

As an example of application of the image forming process of the present invention, an image may be formed in accordance with the same processes as those described above, by using the image transfer material 5, in which a lipophilic resin layer is formed on the substrate, and by using, instead of the image-receiving sheet 11, a drum-shaped plate-body whose outer peripheral surface is a printing plate surface. In this way, a desired detailed image can be formed even on a curved surface, such as the outer peripheral surface of a plate-body, and a plate-body at which a plate is provided can be formed in fewer manufacturing steps.

As a modified example of the discharge head, a discharge head of the type which can discharge droplets of the liquid transferability promoting material in a planar manner or a linear manner can be employed in place of the above-described droplet discharging type. With the discharge head of this type, the same effects can be achieved as those of the above-described droplet discharge head by utilizing a structure in which a mask in which penetration holes are provided image-wisely is provided between the droplet discharge head and the image transfer material or the image receiving sheet. Examples of means by which droplets are discharged in a planar manner include a means having a plurality of discharging holes, a means having a diffusing nozzle, and the like. On the other hand, examples of means by which droplets are discharged in a linear manner include a means by which discharging holes which are disposed linearly along the main scanning direction are moved in the sub-scanning direction, and the like.

In accordance with such an image forming apparatus, because the droplets are discharged in a planar manner, image formation at a high speed can be attained.

EXAMPLES

The present invention will be described in detail hereinafter with reference to Examples. However, the present invention is not limited to the Examples below. Note that, if not stated otherwise, in the Examples, "parts" means "parts by weight".

Example 1

Formation of Image Transfer Material

| Preparation of Transfer Recording Layer Coating Solution | |
|---|---|
| butyral resin (Trade name: ESREK FPD-1 manufactured by Sekisui Kagaku Kogyo Kabushiki Kaisha) | 12.0 parts |
| magenta pigment (Trade Name: LEONOL RED LX-235 manufactured by Toyo Ink Kabushiki Kaisha) | 12.0 parts |
| n-propyl alcohol | 110.4 parts |
| dispersing aid (Trade Name: SOLSPASS S-20000 manufactured by ICI Japan Ltd.) | 0.8 parts |

(Trade Name: SOLSPASS S-20000 manufactured by ICI Japan Ltd.)

A diluent was prepared by adding 0.24 parts of amide stearate and 60 parts of n-propyl alcohol to 10 parts of a dispersion which was prepared by sufficiently dispersing the above coating solution by a disperser. The diluent was applied to a substrate (a polyester film having a thickness of 5 $\mu$m, whose reverse surface was subjected to a releasing treatment) such that the dried thickness thereof was 0.38 $\mu$m, to form the transfer recording layer. The image transfer material was thus obtained.

Formation of Image Receiving Sheet

| First Layer Coating Solution | |
|---|---|
| vinyl chloride/vinyl acetate copolymer (Trade Name: SOLVINE CL2 manufactured by Nisshin Chemicals) | 160 parts |
| ethylene/vinyl acetate copolymer (Trade Name: ELBAROY 742 manufactured by Mitsui Dupont Chemical Kabushiki Kaisha) | 61 parts |
| polyester sebacate (Trade Name: FN-G25 manufactured by Nihon Soda Kabushiki Kaisha) | 28 parts |
| perfluoroalkyl group-containing oligomer (Trade Name: MEGAFAC F-178K manufactured by Dainippon Ink and Chemicals Inc.) | 4 parts |
| methyl ethyl ketone | 630 parts |
| toluene | 210 parts |
| dimethyl formamide | 30 parts |
| **Second Layer Coating Solution** | |
| polyvinylbutyral resin (Trade Name: DENKABUTYRAL #2000-L manufactured by Denki Kagaku Kogyo Kabushiki Kaisha) | 16 parts |
| N,N-dimethyl acrylamide/butyl acrylate copolymer | 4 parts |
| perfluoroalkyl group-containing oligomer (Trade Name: MEGAFAC F-177 manufactured by Dainippon Ink and Chemicals Inc.) | 0.5 parts |
| n-propyl alcohol | 200 parts |

After applying the above first layer coating solution to a substrate (i.e., a PET film having a thickness of 130 $\mu$m) by a rotary application device, and the coated substrate was dried at 100° C. such that the thickness thereof becomes gm after drying. Thereafter, the above second layer coating solution was applied onto the above first layer coating solution by a rotary application device, and the coated substrate was dried at 100° C., such that the thickness of the second layer was adjusted to 2 $\mu$m. As a result, by the above steps, the image receptor was prepared.

| Preparation of the Transferability Promoting Material Solution 1 | |
|---|---|
| distilled water | 7.5 parts |
| isopropyl alcohol | 2.5 parts |

At an image forming apparatus 1 similar to that shown in FIG. 1, the image transfer material 5 and the image receiving sheet 11 were inserted and passed between the supporting drum 3 and the pinch roller 7 in a superposed manner such that the transfer recording layer surface of the image transfer material 5 faced downwardly, and the image receiving surface of the image receiving sheet 11 faced upwardly, as shown in FIG. 1.

At this time, the transferability promoting material solution (surface tension: 32 mN/m; viscosity: 2.6 mpa·s) was jetted from the discharge head 13 image-wisely onto the transfer recording layer surface of the image transfer material 5 to form a latent image. After passing through the pressure rollers where the surface temperature of the pinch roller was set to be 75° C., the transfer body was peeled from the image receptor, and the transfer recording layer was transferred to a portion of the image receiving surface corresponding to the latent image formed portion. As a result, an image was formed. The obtained image was uniform, did not have hue unevenness, and had good hue reproducibility. No wrinkles or warping of the image receiving sheet was detected.

When the image transfer material and the image receiving sheet passed through the present device (with the surface temperature of the pinch roller being set to 75° C.), the temperature of the transfer section (as measured by a sensor nipped between the image transfer material and the image receiving sheet) was 61° C.

Further, in order to investigate the temperatures at which transfer is possible in the transfer section in a case in which the transferability promoting material solution adheres and in a case in which the solution does not adhere, investigations were carried out by making various changes to the surface temperature of the pinch roller of the present device. As a result, it was found that the temperature at which transfer was possible in the transfer section was 47° C. when the solution adhered and 76° C. when no solution adhered.

Example 2

An image was transferred onto the image receiving surface of the image receiving sheet in the same manner as in Example 1, except that transferability promoting material solution 2 having the following formulation was used in place of the transferability promoting material and the surface temperature of the pinch roller was set to 80° C.

| Preparation of the Transferability Promoting Material Solution 2 | |
|---|---|
| distilled water | 10 parts |
| polyoxyethylene (4) lauryl ether | 0.2 parts |

As in above Example 1, the obtained image was uniform, did not have hue unevenness, and had good hue reproducibility. No wrinkles or warping of the image receiving sheet was detected. (The temperature of the transfer section in this Example was 65° C. The surface tension of the transferability promoting material solution 2 was 38 mN/m, and the viscosity thereof was 1.1 mPa·s.)

In the same way as in Example 1, the temperature at which transfer was possible in the transfer section when the transferability promoting material was used was investigated and found to be 57° C.

Example 3

An image was formed in the same manner as that of Example 1, except that the latent image was formed by discharging the transferability promoting material solution 1 onto the image receiving sheet 11 by using the image forming apparatus 20 shown in FIG. 2. The obtained image was uniform, did not have hue unevenness, and had good hue reproducibility. No wrinkles or warping of the image receiving sheet were detected.

Example 4

Preparation of Image Transfer Material

| Preparation of Mother Liquor | |
|---|---|
| butyral resin (manufactured by Sekisui Kagaku Kogyo; trade name ESREK FPD-1; softening point: around 70° C.; average degree of polymerization: 300 or less) | 12.0 parts |
| magenta pigment (manufactured by Toyo Ink; trade name CI; P.R.: 57:1) | 12.0 parts |
| solvent (n-propylalcohol) | 110.4 parts |

-continued

| Preparation of Mother Liquor | |
|---|---|
| dispersing aid (manufactured by ICI Japan; trade name: SOLSPASS S-20000 | 0.8 parts |

(manufactured by ICI Japan; trade name: SOLSPASS S-20000)

A magenta pigment coating solution was prepared by adding 0.24 parts of stearic amide and 60 parts of n-propylalcohol to 10 parts of a dispersed solution in which the above-described mother liquor was sufficiently dispersed by a disperser.

The coating solution was coated and dried to a dried film thickness of 0.36 to 0.38 μm on a polyester film having a thickness of 5 μm, so as to obtain an image transfer material having a transfer recording layer.

| Preparation of Transferability Promoting Material Solution | |
|---|---|
| surfactant having the following formula | 4 parts |
| distilled water | 83 parts |
| propylene glycol | 10 parts |
| polyvinylpyrrolidone (molecular wt: 30,000) | 3 parts |

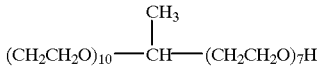

The above polyvinylpyrrolidone functions as a viscosity adjusting agent. After each of the materials was stirred and dissolved uniformly, 1% sodium carbide aqueous solution was added, and the pH was adjusted to 7.5. Thereafter, the mixture was filtered through a 0.45 μm microfilter so as to obtain a solution.

The same image receiving sheet as used in Example was used as the image receiving sheet.

Figure 5:
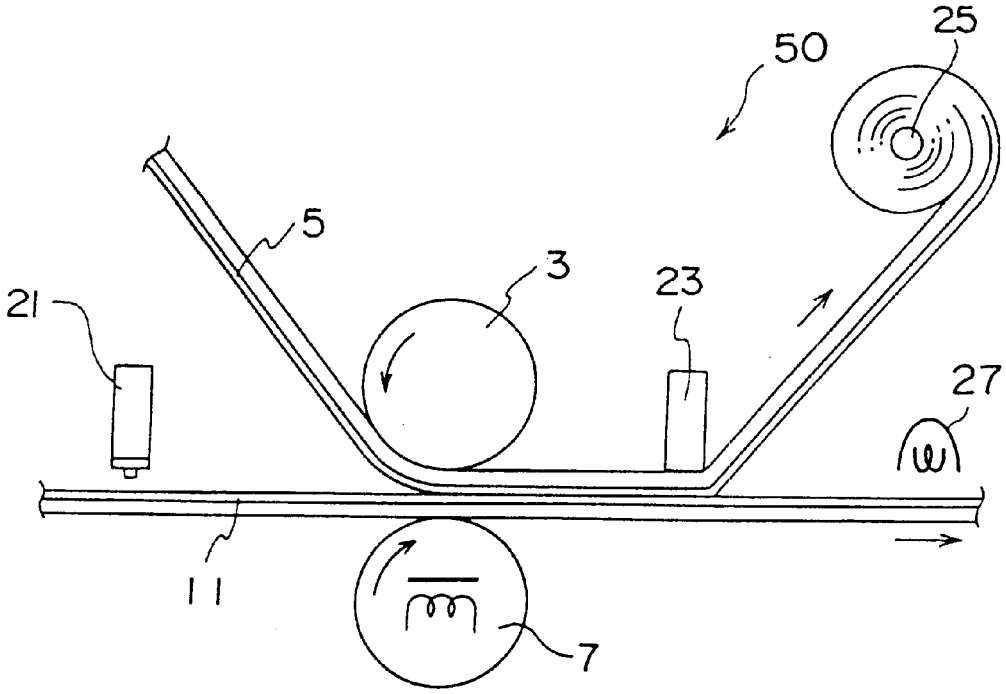
FIG. 5 is a schematic view illustrating an aspect of an image forming device in which the image forming device of FIG. 2 is provided with an overheating drying device.

Image formation was carried out in the same way as in Example 1, except that an image forming device such as that illustrated in FIG. 5 was used. However, the surface of the image receiving sheet after transfer as illustrated in FIG. 5 was heated, and the surface was dried with an overheating drying device 27.

The obtained image had a high resolution, was uniform and lacked color irregularities, and no wrinkles or warping of the image receiving sheet could be detected. Further, the present solution was stable, and no blurring was generated in the image.

Example 5

Preparation of Image Transfer Material

A cyan coating solution was prepared in the same way as the preparation of the image transfer material (magenta) of Example 4, except that the following pigment was used in equal amounts as the pigment, so as to prepare an image transfer material in the same way.

cyan pigment: manufactured by Toyo Ink;

trade name: CI;P.B.: 15:4

| Preparation of Transferability Promoting Material Solution | |
|---|---|
| distilled water | 65 parts |
| surfactant having the following formula (EO additive (EO = 10) of 2,4,7,9-tetramethyl-5-decine-4,7-diol) | 5 parts |
| ethyleneglycolmonobutylether | 30 parts |

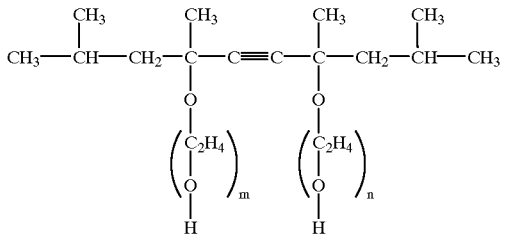

m + n = 10

In the same way as in Example 4, after the pH was adjusted, filtering was carried out so as to obtain a solution.

Using the image transfer material (cyan), transfer was carried out in the same manner as in Example 4, and a cyan transfer image was obtained. The transfer surface of the transfer image was superposed with an art coat paper (128 g/m$^2$). By passing the superposed transfer image and art coat paper through the nip of heat rollers heated to 120° C., a transfer image was obtained on the art coat paper. The obtained image had high resolution and excellent transferability of the fine points. Further, the stability within the image was high, and no blurring was caused.

Example 6

| Preparation of Transferability Promoting Material Solution | |
|---|---|
| polyoxyethylenecetylether (HLB 14.2) | 4 parts |
| distilled water | 84 parts |
| propyleneglycol (boiling point 188.2° C.) | 12 parts |

The above materials were stirred and dissolved uniformly, and the mixture was passed through a 0.45 $\mu$m microfilter so as to obtain a solution. A magenta image transfer material which was the same as Example 4 and an image receiving sheet which was the same as Example 1 were used.

Figure 4:
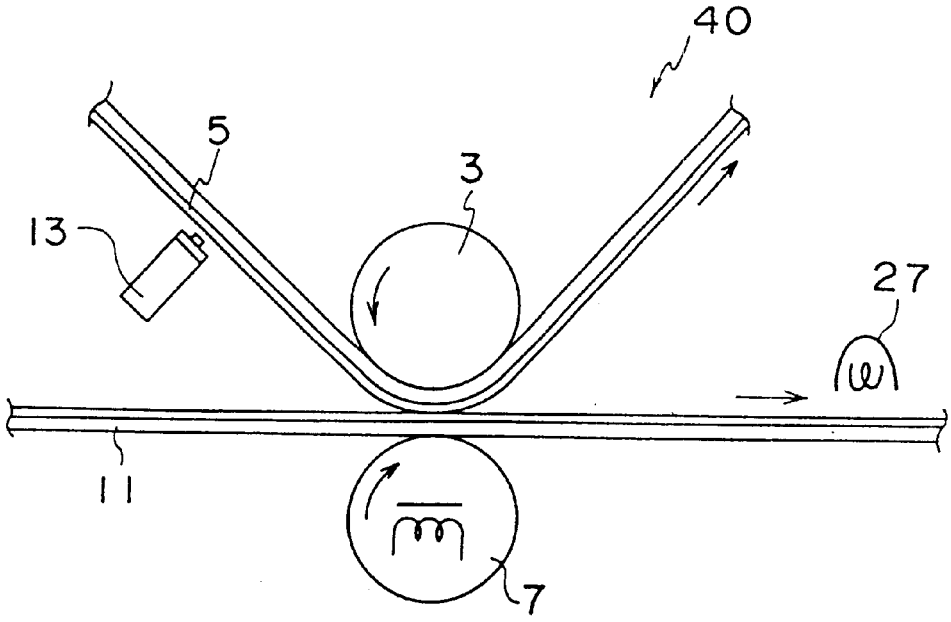
FIG. 4 is a schematic view illustrating an aspect of an image forming device in which the image forming device of FIG. 1 is provided with an overheating drying device.

Image formation was carried out in the same way as in Example 4 except that the image forming device of FIG. 4 including an overheating drying device 27 was used.

The obtained image had high resolution, was uniform, and had no color irregularities. The stability of the present solution was high, and there was no clogging of nozzles during image printing. Further, even after the device was stopped for one week, discharge was started again without any problems.

Example 7

| Preparation of Transferability Promoting Material Solution | |
|---|---|
| distilled water | 85 parts |
| tetraolenic acid polyoxyethylenesolebid HLB 10.5 | 5 parts |
| propyleneglycolmonomethylether (boiling point 119° C.) | 7 parts |

In the same way as in Example 4, the pH was adjusted and filtering was carries out so as to obtain a solution. An image receiving sheet which was the same as that of Example 4 and a cyan image transfer material which was the same as that of Example 5 were used. An image forming device which was the same as that illustrated in FIG. 5 was used. Image formation was carried out in the same manner as in example 4 so as to obtain a cyan transfer image. The obtained image had a high resolution, was uniform, and did not have color irregularities. The present solution was stable, and did not clog in nozzles during image printing. Further, even after the device was stopped for one week, discharge was started again without any problems.

As described above, in accordance with the image forming process of the present invention, the transferability promoting material is applied image-wisely onto an image transfer recording material so as to form a latent image, and the only the latent image formed portion of the transfer body is peeled and transferred onto an image receiving sheet surface. Thus, the range of selection of image forming materials can be broadened greatly, an image which has good hue reproducibility can be formed, and the present invention can be applied to image formation using light-resistant pigments, functional inorganic materials, and the like. Further, a uniform image without color irregularities can be formed without being affected by an uneven temperature distribution caused by unevenness in the thickness of the substrate, unevenness of contact with the thermal head, or unevenness in the diffusion of heat, which were often seen in conventional transfer systems. Further, in the image forming method of the present invention, because the transfer temperature can be lowered, little damage is done to the support of the image receiving sheet.

In accordance with the image forming apparatus relating to the present invention, a transferred image having an excellent hue and uniformity which corresponds to a latent image can be formed on the surface of an image receiving sheet by heated pressure rollers.

What is claimed is:

1. An image forming process comprising the steps of:

(a) providing an image transfer material having a transfer recording layer formed from a heat transfer material and an image receiving sheet having a binder-resin-containing image receiving layer;

(b) image-wisely applying a transferability promoting material to one of the heat transfer material and the image receiving sheet to form a latent image; and (c) applying pressure and heat to the image transfer material to form an image on the image receiving material from the latent image, wherein the step of applying pressure and heat includes using a heating temperature at least equal to a transfer temperature for a portion of the image transfer material bearing the latent image, and no more than a transfer temperature of the heat transfer material.

2. The image forming process of claim 1, wherein the step of image-wisely applying a transferability promoting material includes using a transferability promoting material comprising water.

3. The image forming process of claim 2, further comprising the step of transferring the image to another supporting body.

4. The image forming process of claim 1, wherein the step of image-wisely applying a transferability promoting material includes using a transferability promoting material comprising a nonionic surfactant and water.

5. The image forming process of claim 4, further comprising the step of transferring the image to another supporting body.

6. The image forming process of claim 1, wherein the step of image-wisely applying a transferability promoting material includes using a transferability promoting material comprising water and an organic solvent that is compatible with water and has a boiling point of no less than 100 degrees under typical ambient room conditions.

7. The image forming process of claim 6, further comprising the step of transferring the image to another supporting body.

8. The image forming process of claim 1, further comprising the step of transferring the image to another supporting body.

9. The image forming process of claim 8, further comprising the step of transferring the image to another supporting body.

10. The image forming process of claim 1, wherein the step of image-wisely applying a transferability promoting material includes using a transferability promoting material that is a liquid having a surface tension in a range from 20 to 60 mN/m, a viscosity of no more than 50 Pa·s, and in which the transfer recording layer is substantially insoluble.

11. The image forming process of claim 1, wherein the step of image-wisely applying a transferability promoting material, lowers a transfer temperature of the transfer recording layer by at least 3 degrees C.

12. An image forming apparatus for use with a transferability promoting material and, an image transfer material having a transfer recording layer and a heat transfer material, and an image receiving sheet which has a binder-resin-containing image receiving layer and on which an image is formed, the apparatus comprising:

(a) a droplet discharge head which image-wisely discharges droplets of transferability promoting material for lowering a transfer temperature of the heat transfer material onto one of the transfer recording layer and the image receiving sheet; and (b) a pair of pressure rollers for pressing the image transfer material and the image receiving sheet against one another, at least one of the rollers including a heater for applying heat.

13. The image forming apparatus of claim 12, further comprising a peeling member for peeling the image transfer material from the image receiving sheet after they have been pressed against one another by the rollers.

14. An image forming apparatus for use with a transferability promoting material and image transfer material for forming images according to image data, the apparatus comprising:

(a) an electronically controlled sprayer for spraying transferability promoting material on image transfer material as at least one of the sprayer and image transfer material are moved relative to one another;

(b) an electronically controlled conveyor for moving at least one of the sprayer and the image transfer material relative to one another;

(c) a data processor connected in electronic communication with at least the sprayer for controlling the sprayer to spray transferability promoting material according to image data as the sprayer and image transfer material are moved relative to one another to form a latent image on the image transfer material; and (d) a pressure-heat device which applies heat and pressure to the latent image for forming an image from the latent image, wherein the image transfer material includes a latent image bearing portion and a heat transfer material, and the pressure-heat device is electronically controlled and connected in electronic communication with the data processor, the data processor controlling the pressure-heat device to heat the image transfer material to a temperature at least equal to a transfer temperature for the latent image bearing portion, and no greater than a transfer temperature of the heat transfer material.

15. The image forming apparatus of claim 14, wherein the pressure-heat device includes a pair of rollers rotatably mounted and pressing against one another for receiving the image transfer material therebetween as the rollers rotate, with at least one of the rollers including a heater.

16. The image forming apparatus of claim 15, wherein the sprayer is mounted upstream relative to the rollers, when the rollers rotate for receiving the image transfer material therebetween.

17. The image forming apparatus of claim 16, wherein the apparatus is also for use with image receiving material, and the sprayer is rotatably mounted for directing spray in a first direction towards the image receiving material, and a second direction towards the image transfer material.

* * * * *